US010662670B2

(12) United States Patent
Chen et al.

(10) Patent No.: US 10,662,670 B2
(45) Date of Patent: May 26, 2020

(54) APPARATUS AND METHOD FOR RELIABLE ATTACHMENT TO CHAIN-LINK FENCES AND THE LIKE

(71) Applicants: Huan Ling Chen, New York, NY (US); Thomas Renaud Marie Duc, New York, NY (US)

(72) Inventors: Huan Ling Chen, New York, NY (US); Thomas Renaud Marie Duc, New York, NY (US)

( * ) Notice: Subject to any disclaimer, the term of this patent is extended or adjusted under 35 U.S.C. 154(b) by 0 days.

(21) Appl. No.: 15/672,134

(22) Filed: Aug. 8, 2017

(65) Prior Publication Data

US 2019/0048614 A1 Feb. 14, 2019

(51) Int. Cl.
*E04H 17/12* (2006.01)
*E04H 17/06* (2006.01)

(52) U.S. Cl.
CPC ..... *E04H 17/12* (2013.01); *E04H 17/06* (2013.01)

(58) Field of Classification Search
CPC ..... E04H 17/06; E04H 17/066; E04H 17/12
See application file for complete search history.

(56) References Cited

U.S. PATENT DOCUMENTS 297,487 A * 4/1884 Bacon ..... A01K 3/005 256/4
3,774,884 A * 11/1973 Singer ..... E04H 17/00 256/32
3,964,197 A * 6/1976 Tucker ..... E04H 17/066 40/584
5,177,890 A * 1/1993 Hisatomi ..... E04H 17/163 256/32
5,441,239 A * 8/1995 Watson ..... E04H 17/02 256/1
D417,807 S * 12/1999 McBarnette ..... D6/513
6,669,175 B2 * 12/2003 Snow ..... E04H 17/066 256/1
7,076,898 B1 * 7/2006 Hunt ..... G09F 7/02 256/32
7,887,027 B2 * 2/2011 Garceau ..... E04H 17/066 24/336
8,322,667 B2 * 12/2012 Zannoni ..... A47G 23/0225 248/220.41
2004/0261304 A1 * 12/2004 Edwards ..... E04H 17/066 40/611.01
2005/0274937 A1 * 12/2005 Moore ..... E04H 17/066 256/1
2013/0082155 A1 * 4/2013 McCormack ..... A63B 69/0002 248/220.21

* cited by examiner

*Primary Examiner* — Joshua T Kennedy

(57) ABSTRACT

An apparatus that has a shape and uses a method to securely interweave with chain-link fences and the like without additional fasteners or mechanisms of similar nature. The shape is comprised of an orifice and a gap merging into each other. The interweaving method is a set of orientation-dependent operations established with the relative locations of three elements: apparatus, entanglement and 2 bent wires forming the entanglement.

12 Claims, 5 Drawing Sheets

APPARATUS AND METHOD FOR RELIABLE ATTACHMENT TO CHAIN-LINK FENCES AND THE LIKE

CROSS-REFERENCE TO RELATED APPLICATIONS

Provisional Patent Application No. 62/378,413 filed on Aug. 23, 2016.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM, LISTING COMPACT DISC APPENDIX

Not Applicable

BACKGROUND OF THE INVENTION

Field of the Invention

The invention relates to an apparatus that is interweaved with chain-link fences and the like, more particularly, an apparatus configured to allow for a stable and secure attachment to said fence material.

Background of the Invention

1. On tall fences, fence attachments and the like requiring tools often lack the simplicity of a one-person installation and require multiple people to install.
2. Chain-link fences are often used to hold objects such as signs, lights, decorative embellishments, and the like. There are various ways to attach these objects to the fencing material using clamps, chains, so-called "zip ties," and other attachment means. Many of these current attachment means comprise an inflexible attachment device that requires tools either to attach, to remove, or both.
3. Most current methods of attaching objects to fences have inexistent load bearing capabilities or have load bearing capabilities far below the load capability of the chain-link fence.
4. Most current ways of attaching objects to chain-link fences cannot contain anything within the attachment.
5. Most current methods of attaching objects to chain-link fences either use fasteners that lack a thin profile and protrude out of the chain-link fence, or use fasteners that are difficult to remove when the objects are to be removed from the chain-link fence.
6. There is a need for a device that can be used to attach objects to chain-link fences that can be easily and securely affixed to the chain-link fence and can easily be removed from the chain-link fence when the objects no longer need to be attached.

BACKGROUND ART

Some prior art using elongated slats on chain-link fence and the like are described in U.S. Pat. Nos. 2,760,759; 3,069,142; 3,958,794; 4,725,044; 3,356,343; and 3,355,150.

One problem with prior art chain-link fence assemblies is that these attachments can easily fall off if they don't have additional fasteners, folded metal sheets as clips, or other similar fixing mechanisms or parts.

BRIEF SUMMARY OF THE INVENTION

1. The invention comprises an apparatus that interweaves securely with chain-link fences and the like.
2. The method of interweaving the apparatus with the chain-link fence can be initialized and completed from either side of chain-link fences and the like.
3. The apparatus can remain on a chain-link fence and the like in high vibration or high impact condition without fasteners.

BRIEF DESCRIPTION OF THE SEVERAL VIEWS OF THE DRAWING

Various other objects, features and attendant advantages of the present invention will become fully appreciated as the same becomes better understood when considered in conjunction with the accompanying drawings, in which like reference characters designate the same or similar parts throughout the several views, and wherein:

FIG. 7-1 is a perspective view showing the third step of the interweaving method.

FIG. 7-2 is a perspective view showing the fourth step of the interweaving method.

FIG. 7-3 is a front view showing one possibility of the fifth step of the interweaving method.

DETAILED DESCRIPTION OF THE INVENTION

The Shape of the Apparatus

The apparatus has an inner orifice and a gap. The gap runs from the outer edge of the apparatus to the inner orifice located at the center of the apparatus, or alternatively at some interior location of the apparatus. An optional securing member may be inserted into the gap, held in place by friction.

Figure 1:
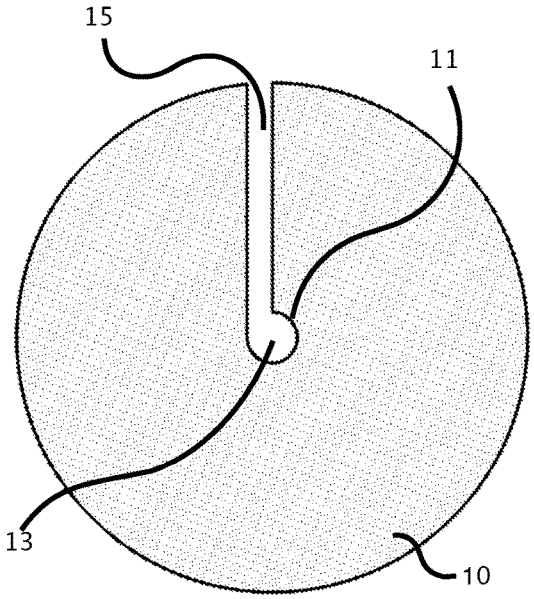
FIG. 1 is a top view of the apparatus.
Figure 2:
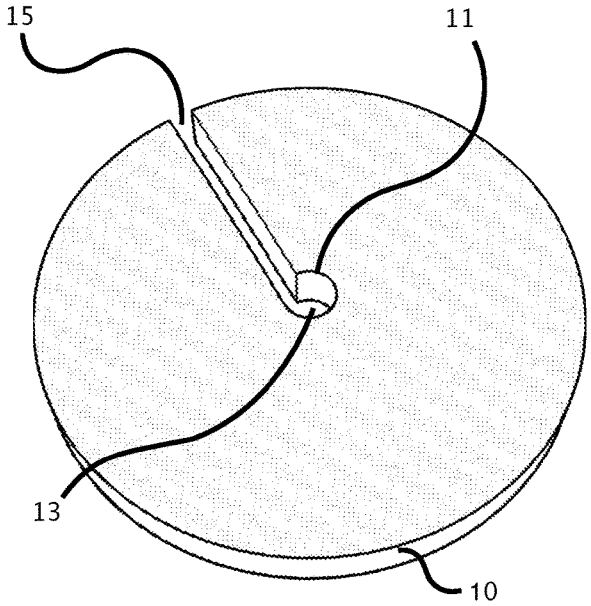
FIG. 2 is a perspective view of the apparatus.
Figure 3:
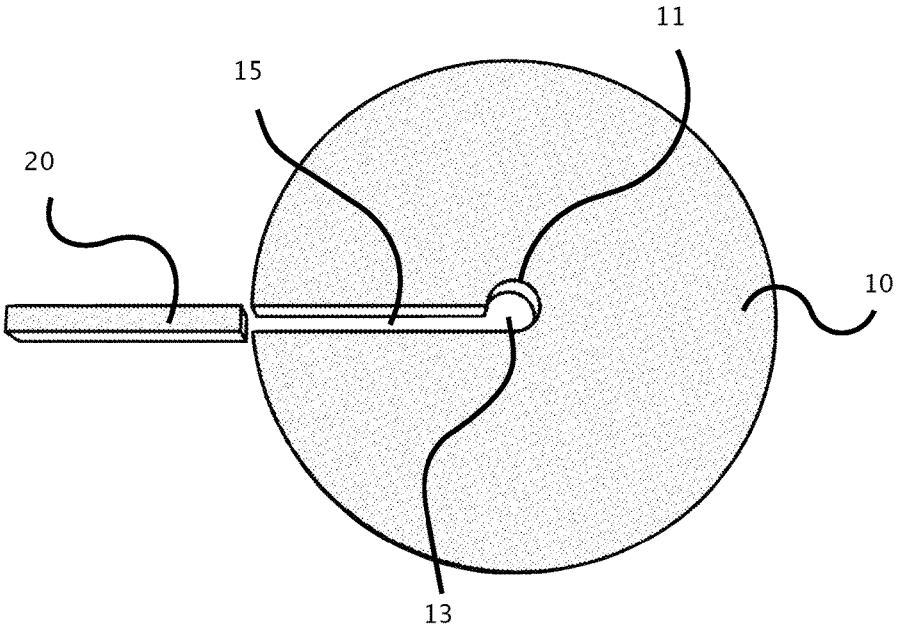
FIG. 3 is a perspective view showing the apparatus and an optional securing piece.

As shown in FIG. 1 and FIG. 2, the apparatus 10 comprises a gap 15 that continues from the edge of apparatus 10 to orifice 13, located at the center of the apparatus 10 or at some other suitable interior location on the apparatus. The gap 15 is in the form of a gap of about the width of the fence wire over which it will be inserted. The orifice 13 and the gap 15 merge into each other. The radius of orifice 13 is at least the width of a fence wire. Curve 11 is the portion of the perimeter of orifice 13 that connects perpendicularly to gap 15. As shown in FIG. 3, an optional securing member is 20 that can be inserted into gap 15 and held in place by friction. The apparatus 10 can be alternatively secured in place when attached to the fence by inserting securing member 20 in gap 15.

Interweaving Method

Chain-link fences and the like are made of interwoven wires. These interwoven wires form patterns of wire entanglements and wire segments. The present invention utilizes the pattern and 3-dimensional properties of the apparatus and the chain-link fence to interweave the apparatus onto chain-link fences and the like.

Figure 4:
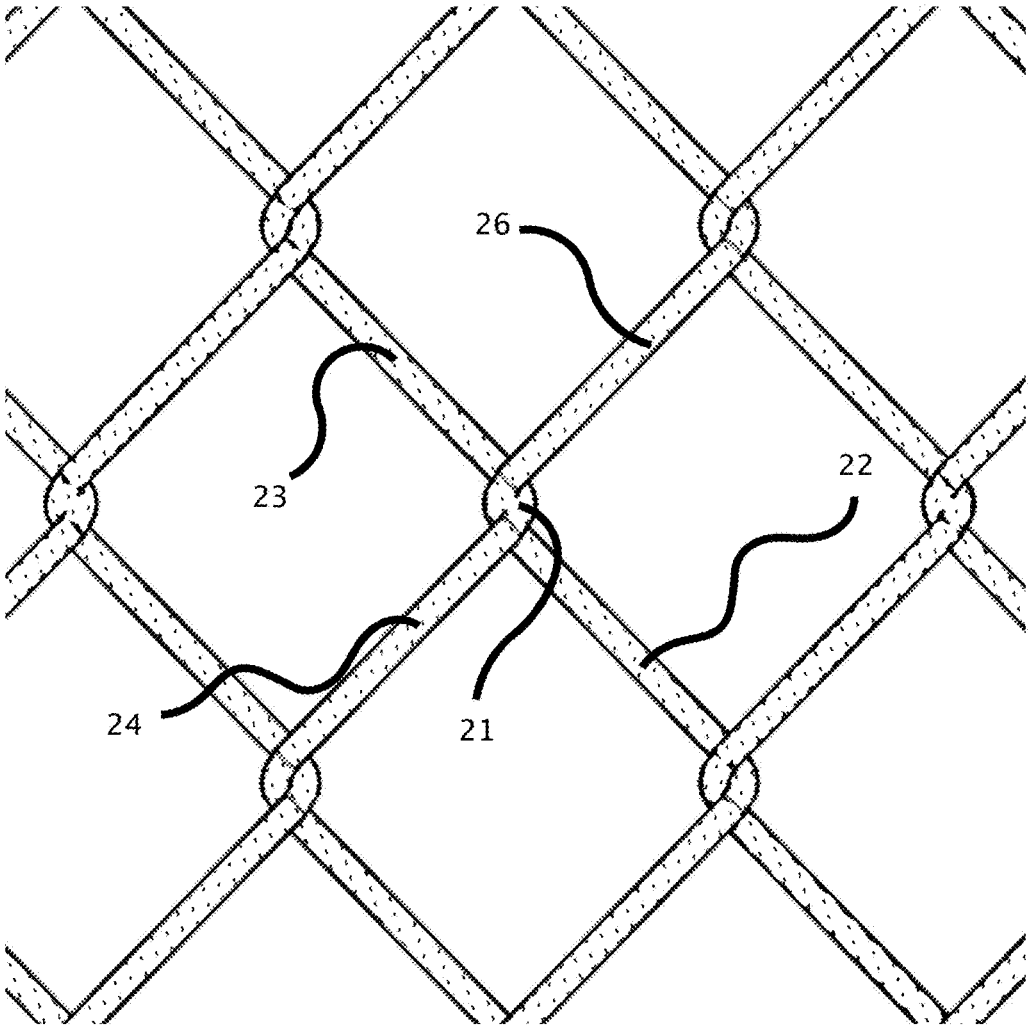
FIG. 4 is a front view of a chain-link fence.

Wire pattern (A), as shown in FIG. 4, this front view shows that wires change direction after bending. A wire segment 22 and a wire segment 24 join at an entanglement 21. After the entanglement, wire segment 22 continues as wire segment 26; wire segment 24 continues as wire segment 23.

Figure 5:
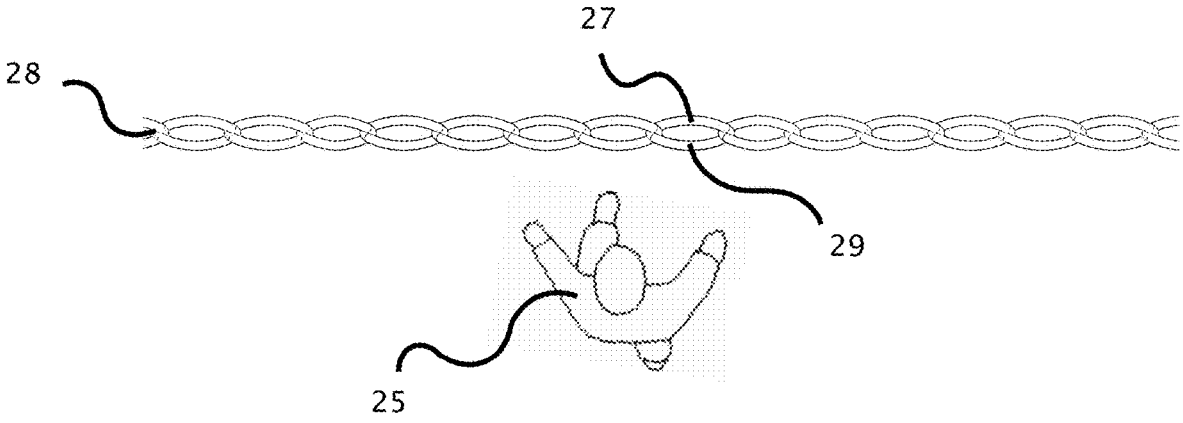
FIG. 5 is a top view of a person facing a chain-link fence.

Wire pattern (B), as shown in FIG. 5, this top view shows that wires change direction after bending. A person 25 stands in front of a chain-link fence and the like 28 can see this pattern. A wire segment is bent to different positions either in a forward-facing placement 29 or a rearward-facing placement 27.

Step 1 of Interweaving Method: Wire Segment Selection.

As shown in FIG. 5, either a rearward-facing wire segment 27 or forward-facing wire segment 29 can be selected for insertion. A rearward-facing wire segment 27 should be selected for simple insertion. When selecting a forward-facing wire segment 29, an additional rotation is required to position the apparatus 10 for proper insertion.

Step 2 of Interweaving Method: Orientation and Insertion

Figure 6:
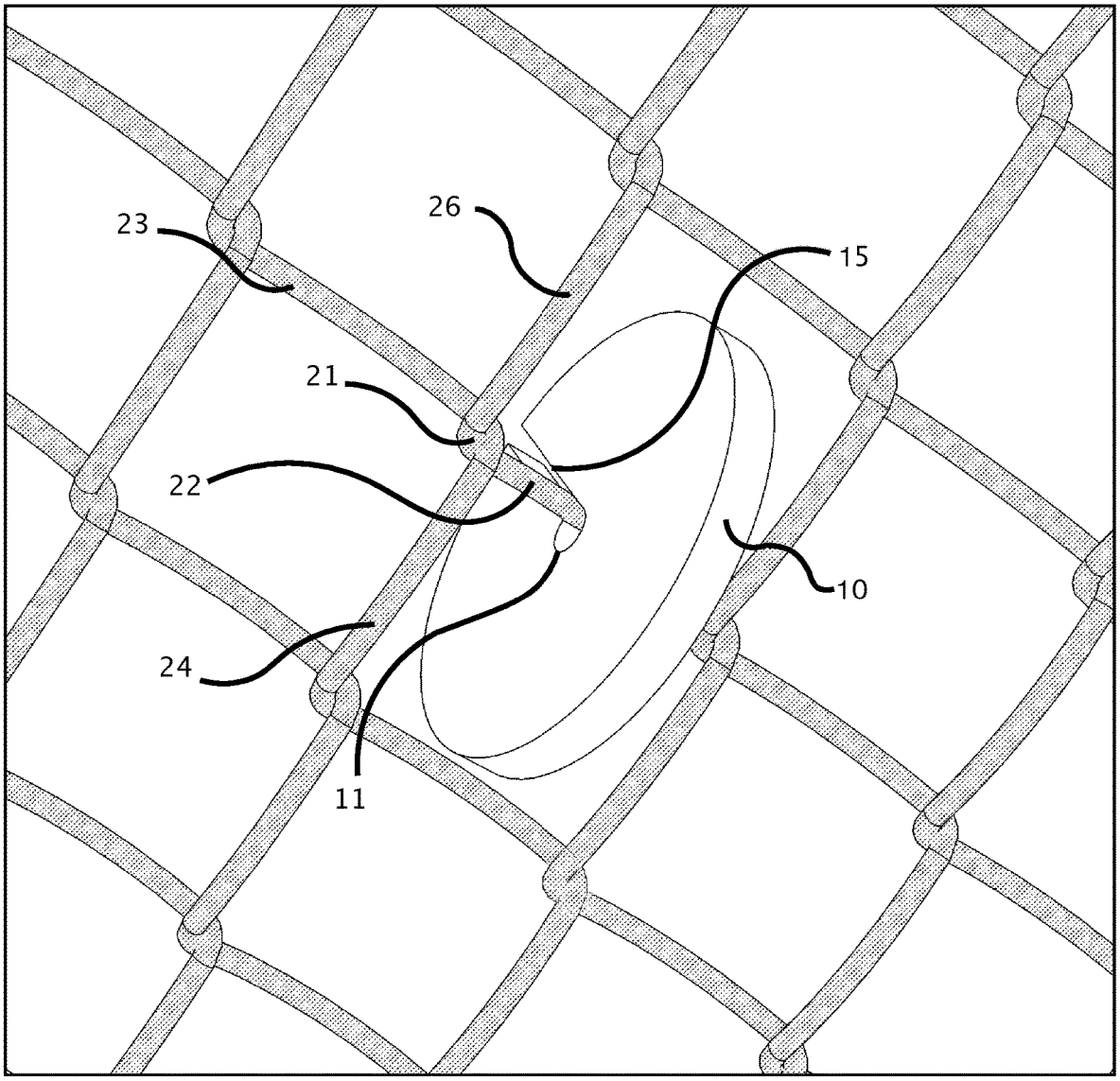
FIG. 6 is a perspective view showing the first and second step of the interweaving method.

As shown in FIG. 6, when inserting apparatus 10 to a chain-link fence, two planes intersect: a plane defined by the largest surface of apparatus 10, and a plane defined by the chain-link fence. A direction on each plane is used to orient apparatus 10 before insertion. The first direction on the plane defined by apparatus 10 is from the gap 15 to convex curve 11. The second direction on the plane defined by the chain-link fence depends on the wire segment chosen: either a rearward-facing or a forward-facing segment.

When selecting a rearward-facing wire segment as wire segment 22 to insert apparatus 10 around entanglement 21, the apparatus 10 must be oriented so that: the direction from the gap 15 to convex curve 11 is opposite to the direction from entanglement 21 to wire segment 26.

When selecting a forward-facing wire segment as wire segment 24 to insert apparatus 10 around entanglement 21, the apparatus 10 must be oriented so that the direction from the gap 15 to convex curve 11 is the same as the direction from entanglement 21 to wire segment 23. After insertion, apparatus 10 must then be rotated 180 degrees around the axis created by wire segment 24.

Figures 1, 7:
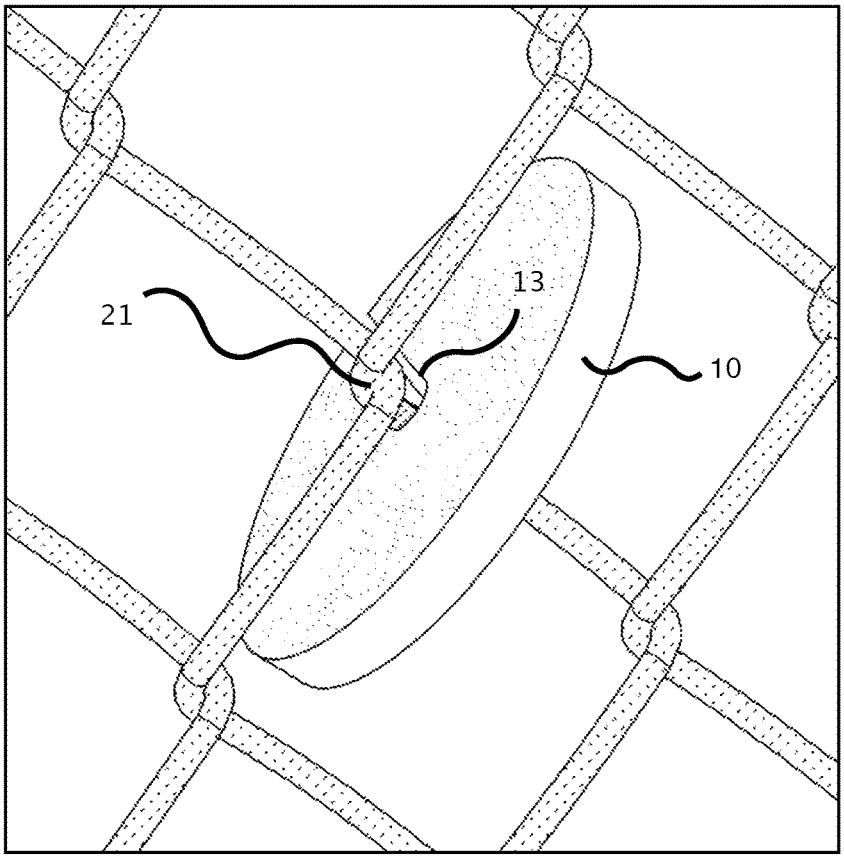
Figures 2, 7:
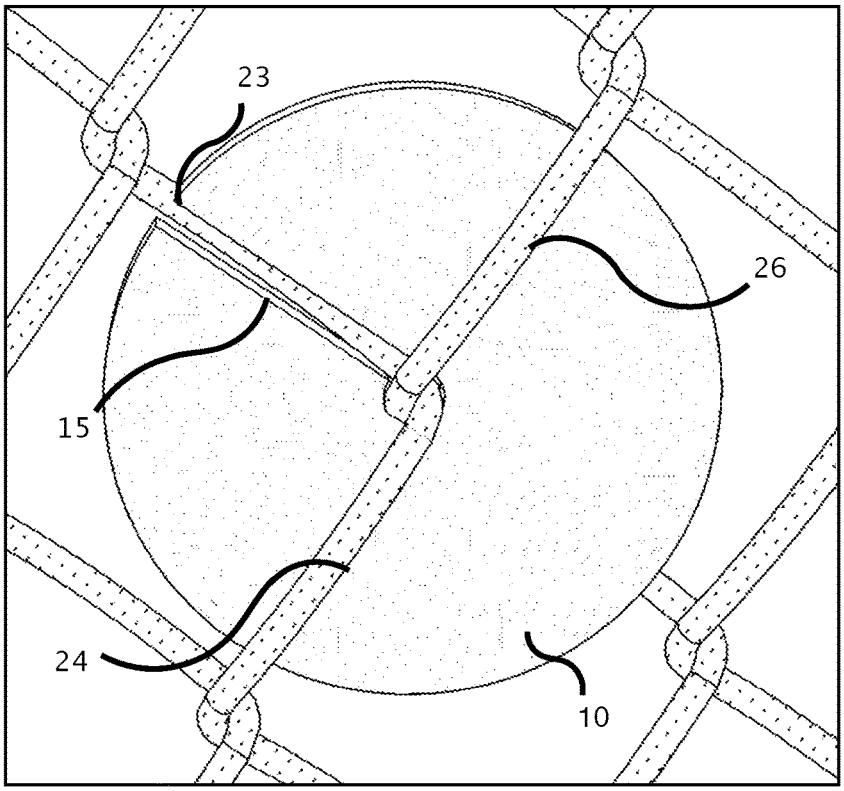
Figures 3, 7:
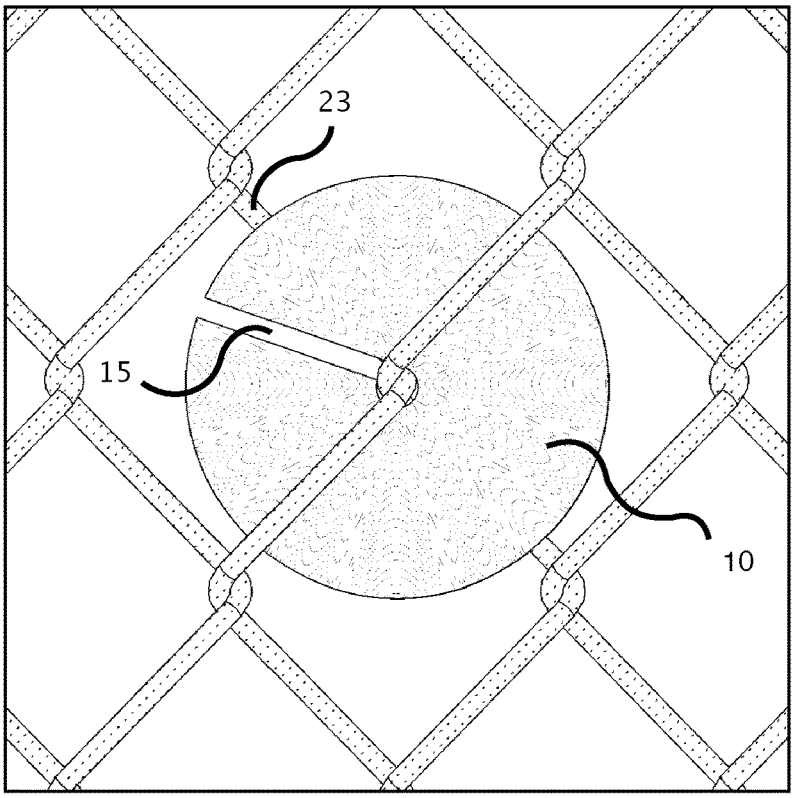

Step 3 of interweaving method: Positioning, as shown in FIG. 7-1, in this case using rearward-facing wire segment 22. The apparatus 10 is moved closer to wire entanglement 21 until orifice 13 touches the wire entanglement 21.

Step 4 of Interweaving Method: Pivoting, as Shown in FIG. 7-2

The apparatus 10 is pivoted around the axis created by forward-facing wire segments 24 and 26. The apparatus 10 is pivoted towards rearward-facing wire segment 23 until gap 15 crosses over wire segment 23.

Step 5 of Interweaving Method: Confining

In order to confine the apparatus 10 on the chain-link fence, the gap 15 of the apparatus should not be in front of wire segment 23. Rotating the apparatus, as shown in FIG. 7-3 confines the apparatus 10 on the chain-link fence.

Optional Step: Securing

Figure 8:
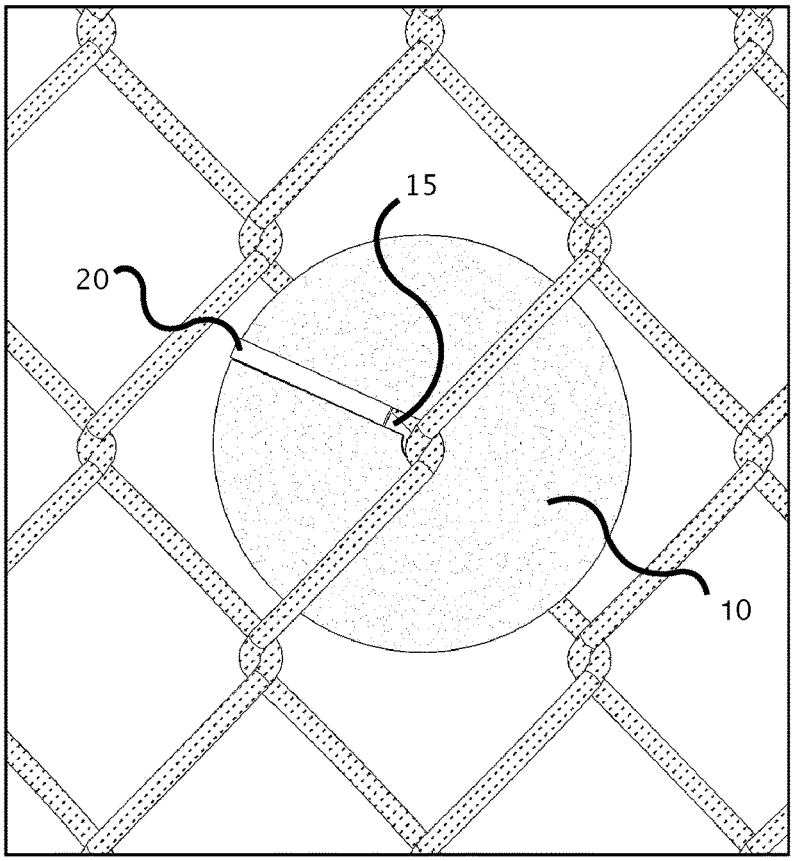
FIG. 8 is a front view showing an optional step of the interweaving method.

Adding an optional piece 20, as shown in FIG. 8 can secure the apparatus whether the gap 15 is in front of a wire segment or not. Alternative shapes of the securing member may hold fasteners to prevent unwanted removal.

It should be understood that apparatus 10 can be circular as shown, or may assume other shapes as desired provided the overall dimensions of apparatus 10 do not exceed the distance between any three parallel chain-link fence wires. Apparatus 10 can be constructed from a wide range of materials depending on intended use. Where, for example, apparatus 10 will be used to secure material to a chain-link fence, apparatus 10 may be constructed of impact-resistant plastic, a non-corrosive metal such as aluminum or galvanized steel, or wood that has been treated to resist moisture. In such a case, the material to be secured to a chain-link fence can be attached to apparatus 10 by any number of means known to those skilled in the art. Another use for apparatus 10 is as a means to host sub-systems like for example electronics. In this case, apparatus 10 may be constructed to meet the protection requirements. Another use for apparatus 10 is to provide stronger hanging solutions by allowing other materials to be integrated onto or with apparatus 10. In such case, more hanging designs are possible as long as they are within the load bearing capacity of the chain-link fence. Another use for apparatus 10 is decorative or to create readable messages on chain-link fences by using a multiplicity of apparatus 10 arrayed in the form of letters, with or without background, using one or more colors as appropriate given the use. In such cases, apparatus 10 can be constructed of thinner materials, as there will be no additional weight placed on the device.

The invention claimed is:

1. An apparatus shaped to weave with a chain-link fence with an interweaving method, the chain link fence being defined by wire entanglements of adjacent wires, the apparatus comprising:

(a) a body having an outer edge, an orifice, and a gap, a diameter of the body configured to be no more than the sum of a length of one wire entanglement and twice the longest distance between two neighboring and non-contiguous entanglements;

(b) the orifice extending through and being located within the body and having a diameter configured to accept a wire entanglement of a chain-link fence; and (c) the gap connecting the orifice to the outer edge of the body;

wherein the gap and orifice having a width less than the diameter of the orifice at least at the juncture of the orifice and the gap to create a necked portion which is configured to maintain engagement between the body and a wire entanglement.

2. The apparatus of claim 1 where the apparatus is comprised of a semi-flexible material.

3. The apparatus of claim 1 where the apparatus is comprised of a rigid material.

4. The apparatus of claim 1 configured such that other material may be attached to the apparatus.

5. The apparatus of claim 1 where the apparatus is comprised of a flexible material.

6. The apparatus of claim 1 where the apparatus is comprised of a foldable material.

7. A method to secure an apparatus within a chain-link fence, comprising the steps of:

(a) orienting and inserting the apparatus onto a first wire segment of a chain-link fence, the apparatus comprising a body having an outer edge, an orifice, and a gap, a diameter of the body configured to be no more than the sum of a length of one wire entanglement and twice the longest distance between two neighboring and non-contiguous entanglements; the orifice extending through and being located within the body and having a diameter configured to accept a wire entanglement of a chain-link fence; and the gap connecting the orifice to the outer edge of the body; wherein the gap and orifice having a width less than the diameter of the orifice at least at the juncture of the orifice and the gap to create a necked portion which is configured to maintain engagement between the body and a wire entanglement;

(b) at the point where the first wire segment of the chain-link fence twists around a second wire segment of the chain-link fence, pivoting the apparatus towards a plane defined by the chain-link fence until the gap of the apparatus passes around the second wire segment that is substantially aligned with an inserted wire segment; and (c) turning the apparatus in either a clockwise or counter-clockwise direction until said gap is no longer aligned with said second wire segment of the chain-link fence, thus confining the apparatus on the chain-link fence.

8. The method of claim 7, where an insertion of the apparatus in the chain-link fence as the gap points to the first wire segment located such that the first wire segment falls under other segments when forming an entanglement selected for insertion when viewing from the side of the insertion with an orientation where from a center of the orifice to a portion of borders of the orifice shaped such that the portion intends to accommodate the wire entanglement near a bend made by the first and second wire segments, is configured relatively opposite to a direction from the wire entanglement to a wire segment prolonging and perpendicular to the inserted wire segment after the wire entanglement.

9. The method of claim 7, where an insertion of the apparatus in the chain-link fence as the gap points to the first wire segment located such that the first wire segment extends over other segments when forming an entanglement selected for insertion when viewing from the side of the insertion with an orientation where from a center of the orifice to a portion of borders of the orifice shaped such that the portion intends to accommodate the wire entanglement near a bend made by the first and second wire segments, is configured relatively the same as a direction from the wire entanglement to a wire segment prolonging and perpendicular to the inserted wire segment after the wire entanglement; after insertion, the apparatus must be rotated 180 degrees around an axis created by the inserted wire segment.

10. A method to secure an apparatus within a chain-link fence, comprising the steps of:

(a) orienting and inserting an apparatus onto a first wire segment of a chain-link fence, the apparatus comprising a body having an outer edge, an orifice, and a gap, a diameter of the body configured to be no more than the sum of a length of one wire entanglement and twice the longest distance between two neighboring and non-contiguous entanglements; the orifice extending through and being located within the body and having a diameter configured to accept a wire entanglement of a chain-link fence; and the gap connecting the orifice to the outer edge of the body; wherein the gap and orifice having a width less than the diameter of the orifice at least at the juncture of the orifice and the gap to create a necked portion which is configured to maintain engagement between the body and a wire entanglement;

(b) at the point where the first wire segment of the chain-link fence twists around a second wire segment of the chain-link fence, pivoting the apparatus towards a plane defined by the chain-link fence until the gap of the apparatus passes around the second wire segment that is substantially aligned with the inserted wire segment; and (c) inserting a securing mechanism into said gap of the apparatus, thus securing the apparatus on the chain-link fence.

11. The method of claim 10, where an insertion of the apparatus in the chain-link fence as the gap points to the first wire segment located such that the first wire segment falls under other segments when forming an entanglement selected for insertion when viewing from the side of the insertion with an orientation where from a center of the orifice to a portion of borders of the orifice shaped such that the portion intends to accommodate the wire entanglement near a bend made by the first and second wire segments, is configured relatively opposite to a direction from the wire entanglement to a wire segment prolonging and perpendicular to the inserted wire segment after the wire entanglement.

12. The method of claim 10, where an insertion of the apparatus in the chain-link fence as the gap points to the first wire segment located such that the first wire segment extends over other segments when forming an entanglement selected for insertion when viewing from the side of the insertion with an orientation where from a center of the orifice to a portion of borders of the orifice shaped such that the portion intends to accommodate the wire entanglement near a bend made by the first and second wire segments, is configured relatively the same as a direction from the wire entanglement to a wire segment prolonging and perpendicular to the inserted wire segment after the wire entanglement; after insertion, the apparatus must be rotated 180 degrees around an axis created by the inserted wire segment.

* * * * *